United States Patent [19]

Zeug

[11] Patent Number: 4,466,827

[45] Date of Patent: Aug. 21, 1984

[54] METHOD FOR MELTING METALS

[76] Inventor: Josef Zeug, Nachtigallenweg 13, 7030 Böblingen-Tannenberg, Fed. Rep. of Germany

[21] Appl. No.: 475,939

[22] Filed: Mar. 16, 1983

Related U.S. Application Data

[62] Division of Ser. No. 221,258, Dec. 30, 1980, Pat. No. 4,378,105.

[30] Foreign Application Priority Data

Feb. 9, 1980 [DE] Fed. Rep. of Germany ..... 3004906

[51] Int. Cl.[3] ..... C22B 21/00

[52] U.S. Cl. ..... 75/65 R; 75/68 R

[58] Field of Search ..... 75/65 R, 68 R

[56] References Cited

U.S. PATENT DOCUMENTS 2,656,171 10/1953 Markley ..... 266/242

FOREIGN PATENT DOCUMENTS 1121161 4/1956 France ..... 266/242

*Primary Examiner*—M. J. Andrews

*Attorney, Agent, or Firm*—Kenyon & Kenyon

[57] ABSTRACT

Metal is melted in melting vessels heated in a melting furnace by combustion of fuel and by exhaust gases from the combustion. In order to prevent evaporation, overheating and contamination of the melt, the exhaust gases of the melting furnace, including unburned fuel components of the exhaust gases, are directed through a channel of limited cross-sectional size into a melting chamber os substantially larger cross-sectional size. The hot gases are directed against the surface of melting vessels in the furnace and are allowed to expand in the melting chamber to transfer heat to melting vessels there. In addition, the hot gases are retained and the unburned components are burned in the melting chamber so that their heat capacity is given off to objects within the melting chamber to be stored in those objects to achieve a high degree of utilization of the fuel.

3 Claims, 2 Drawing Figures

METHOD FOR MELTING METALS

This is a division of application Ser. No. 221,258, filed Dec. 30, 1980, now U.S. Pat. No. 4,378,105.

BACKGROUND OF THE INVENTION

1. Field of the Invention

The invention relates to a method and apparatus for melting metals, particularly light, heavy and noble metals, as well as the alloys thereof, in crucibles or trays by combustion of liquid, gaseous or solid fuels, and by exhaust gases produced by such fuels.

2. Discussion of the Prior Art

In order to improve thermal efficiency in the melting of metals, a number of proposals have been made, one of which is to use a crucible melting furnace with a premelter through which the furnace exhaust gases flow, as disclosed in German Pat. No. 444 535. One disadvantage of such furnaces is that the dirt particles carried along by the furnace exhaust gases are deposited on the metal to be pre-heated, which leads to considerable contamination and gas penetration of the melting bath when new material is introduced to re-charge the bath.

An attempt to eliminate these short-comings by an indirectly heated pre-heating chamber is described in German Pat. publication No. AS 12 10 132. The proposal there was to separate the pre-heating chamber, in which the scrap was heated, from the exhaust gas flues by a gas-tight partition. Although this eliminated the above-mentioned disadvantages regarding the feeding of dirt particles onto the metal to be pre-heated, the thermal efficiency could not be increased nor fully utilized because of the relatively low thermal conductivity of the partition, especially since the material to be melted is heated from only one side (from below), and heat transfer through radiation (from above) is not sufficient.

OBJECTS AND SUMMARY OF THE INVENTION

It is an object of the invention to provide a method and apparatus to prevent evaporation, over-heating and contamination of metal while the metal is being melted.

Another object is to provide a melting process in which a uniform temperature distribution is achieved over the entire surface of the melting vessel with the most economical fuel consumption obtainable, and thereby, with the highest possible thermal efficiency.

According to the present invention, metal to be melted in a melting furnace is put in melting vessels, such as crucibles or trays, in a melting chamber connected to the furnace, and hot furnace exhaust gases are directed through a channel of limited cross-section opening that joins the furnace space to the space in the melting chamber so that they flow through the melting chamber directly against the surface of the melting vessels. The gases expand upon leaving the channel and entering the melting chamber and are backed up so that the unburned fuel components in the exhaust gases can be returned to be burned in the melting chamber to provide additional heat to be stored by objects in the melting chamber. Preferably the opening through which the gases from the furnace are required to pass to reach the melting chamber is a closable one, and the cross-sectional area of the opening is in the range of about 8 to 12 times smaller than the cross-section of the melting chamber. This causes a back-up of the exhaust gases in the melting chamber due to the sudden increase in the gas flow area at the output side of the opening.

Exhaust gases from the melting chamber are directed into a chimney through an entrance, the cross-sectional area of which is also controllable by a slider to determine the volume and temperature of the exhaust gas. An additional slider may be arranged in the chimney itself and connected by an interlock to be actuated by the burner. In order to hold the heat and have it available, the melting chamber preferably has an outer heat insulating wall and an inner wall that stores and reradiates the heat. Baffles, which may be adjustable, can be arranged in the melting chamber or in the melting furnace or both and can be moved from one location to another.

According to the invention, the metal charges in the melting vessels in the melting chamber do not come into contact with the furance exhaust gases and are melted down without residue in a relatively short time period. The melting process is aided by making the inner walls of the melting chamber so that they include a layer consisting of a material with high heat storage capacity, e.g., magnesite, and which is protected from losing heat to the surrounding outer space by ample and careful insulation. The melt can subsequently either be fed to the melting furnace or poured directly from the melting chamber melting vessels. When the melt is taken into the melting vessels charged with ingots and pigs of the melting furnace, the air spaces previously existing between the melting vessel wall and the metal are filled with liquid metal, and heat transfer is improved thereby, so that the overall meltinq time is shortened. Furthermore, the method according to the invention makes it possible to process small charges of different alloys through the melting chamber simultaneously and separately than was possible heretofore.

An improvement in the apparatus, as compared with known apparatus, is that it can be added onto already existing melting facilities without particular technical difficulties or large financial expenditures.

Further in accordance with the present invention, the residual oxygen content in the region of the melting chamber is substantially lower, because of closed combustion, than in the melting furnace to which the chamber is connected. In addition, the flow velocity of the exhaust gases is lower in the melting chamber than in the melting furnace. The result of both of these factors is that the service life of the melting vessels in the melting chamber can be several times as great as the service life of the melting vessels in the melting furnace.

DETAILED DESCRIPTION OF THE INVENTION

Figure 1:
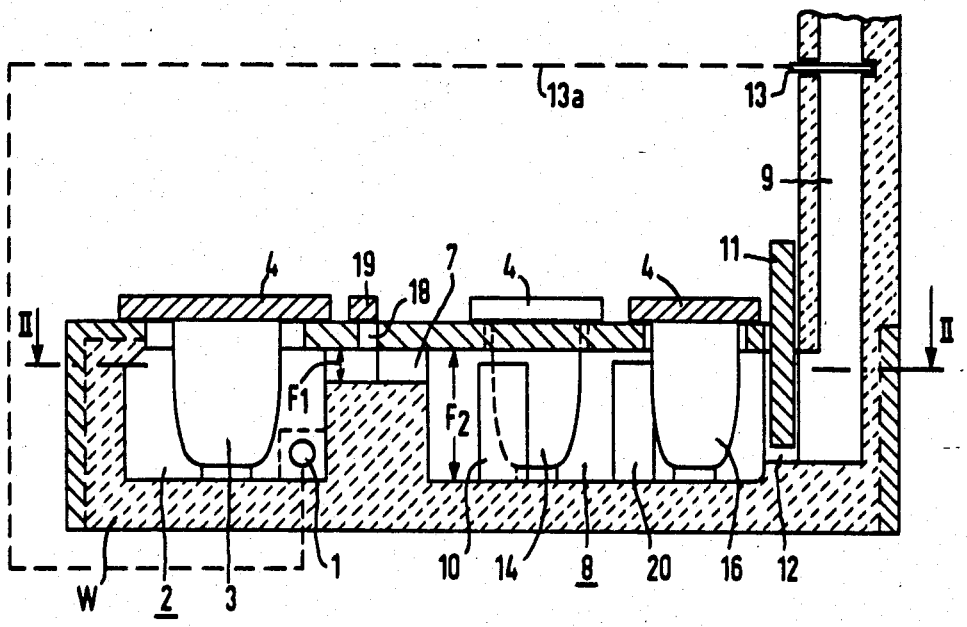
FIG. 1 shows a simplified cross-sectional side view of apparatus constructed according to the invention.
Figure 2:
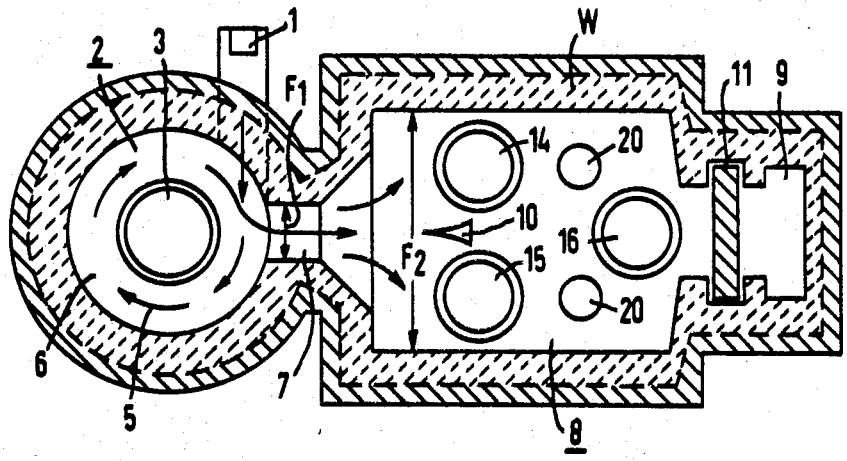
FIG. 2 is a cross-sectional view of the apparatus of FIG. 1 along the section line II—II.

According to FIGS. 1 and 2, a melting furnace 2 operated by means of an oil burner 1 is equipped with a melting vessel in the form of a crucible 3 that has been charged with the metal to be melted, for example, aluminum, although it could be another light, heavy or noble metal, or an alloy thereof. The top of the crucible extends through an opening in the furnace 2 and the rim of the crucible is at the same level as the upper surface of the furnace, so that a lid 4 can simultaneously cover the crucible and close the opening in the top of the melting furnace. The burning heating gases of the oil burner 1, designated by arrows 5 that represent the direction of flow, are conducted tangentially into the combustion chamber 6 where they circulate about the crucible to heat it to the desired temperature and are then allowed to flow out through an exhaust gas channel 7. The channel 7 has a cross-section $F_1$ and leads to a melting chamber 8 that has a cross-section $F_2$. A chimney 9 is located on the opposite end of the melting chamber 8.

In order to cause the exhaust gases to sweep through the relatively large cross-section of the melting chamber 8 in such a manner that a uniform temperature distribution is obtained, baffles, such as baffle 10, may be provided in the melting chamber.

A slider 11 is provided at the chimney entrance in a manner known per se to control the chimney draft. This slider has, for instance at its lower end, a safety opening 12 that insures the discharge of the exhaust gases into a region of lower pressure. The slider 11 which makes it possible to obtain a certain amount of backup effect for the exhaust gases so that they have sufficient opportunity to discharge the heat still contained therein, can be controlled either by hand or by a powered drive mechanism in a manner known per se.

If the oil burner 1 is shut off by a conventional control when the pouring temperature of the melt liquid is reached, it is preferable, in order to maintain as high a level of thermal efficiency as possible, to avoid having stored heat escape through the natural chimney draft. A further slider 13, which has no safety slot, may be arranged in the chimney 9 to help keep the stored heat from getting into the open air through the natural chimney draft. The slider 13 and the oil burner 1 are mutually interlocked, as indicated by the line 13*a*, so that the oil burner 1 can be switched on only if the slider 13 is open.

In the drawing, three crucibles 14–16 are shown in the melting chamber 8, the two crucibles 14 and 15 being arranged on opposite sides of the longitudinal axis of the furnace, while the crucible 16 nearest the slider 11 is in the vicinity of the longitudinal axis of the furnace. Like the crucible 3, the crucibles 14–16 extend through openings in the top of the melting chamber 8 with the rims of the crucibles 14–16 being coplanar with the top surface of the melting chamber so that these crucibles and the melting chamber can be closed by the lids 4.

In order to obtain a high heat storage value, which is desirable for the melting process, and to prevent the operating personnel working at the furnace from being affected by escaping exhaust gases, it is necessary to adjust the slider 11 so that, depending on the type of burner system installed, the velocity of the exhaust gases leaving through the exhaust gas channel 7 is reduced by increasing the open cross-section $F_2$ of the melting chamber 8 to be about 8 to 12 times as great as the cross-section of channel 7.

This invention assures substantially complete combustion of the fed-in fuel, except during a cold start. The hydrocarbon particles getting into the melting chamber still unburned are completely cracked at this point and are completely burned up by means of the stored heat. In order to compensate for pressure variations during a cold start, an opening 18 is provided in the exhaust gas channel 7, the cross-section of which can be adjusted accordingly, in the simplest form, for instance, by moving a cover block 19.

To equip the melting chamber space fully with radiating surfaces W, it is advantageous to provide in the melting chamber 8 additional heat radiating elements 20 of highly heatstoring materials, for instance, cylinders of magnesite.

Tests have shown that with the arrangement described, and in conjunction with the pressure-dependent and temperaturedependent control customary for the entire furnace installation, a considerable increase of the melting capacity can be produced with the same fuel consumption, so that the investment costs for such installations can be amortized in a short time.

The embodiment described can be modified without deviating from the true scope of the invention. For example, it is possible to use, instead of the oil burner, such other heat sources as gas or solid fuels. In addition, trays can also be used instead of the crucibles shown, especially for large-scale installations. It is also possible to adapt the shape and the dimensions of the melting chamber to the local conditions and to choose, instead of the rectangular form shown in the drawing FIG. 2, a different shape, for instance, a shape tapered in the direction toward the chimney. The plant may be constructed so that the individual steps of the process, as well as the entire operating cycle, can be carried out automatically by means of program controls of known types.

What is claimed is:

1. An improved method of operating a melting furnace, for melting metals and metal alloys, said melting furnace comprising:

a. furnace chamber;

b. a first melting vessel disposed within said furnace chamber;

c. means to produce hot combustion gases and direct said gases on said first melting vessel in said furnace chamber;

d. at least one additional heat insulated chamber for receiving a metal mass to be heated;

e. an exhaust gas canal coupling said furnace chamber to said additional chamber, the input cross section of said additional chamber being larger than that of the exhaust gas canal; and f. a single chimney connected only to said additional chamber, comprising:

g. forming the additional chamber into a melting chamber having an open cross section maintained at a size such that at least one second melting vessel may extend into it;

h. disposing a second melting vessel containing metals to be melted so as to extending into and be acted upon all sides by the exhaust gases in said melting chamber;

i. directing the hot combustion gases of the furnace chamber through said exhaust gas canal into said melting chamber;

j. allowing the hot combustion gases to expand in the melting chamber to transfer heat to the outer surfaces of the second melting vessel;

k. backing up the hot combustion gases in the melting chamber;

l. burning unburned fuel in said hot combustion gases which are exhausted to said melting chamber to generate additional heat to be transferred to said second melting vessel in the melting chamber; and m. melting the metals in said second melting vessel with the heat from said hot exhaust gases and the heat generated by burning said unburned fuel.

2. The method according to claim 1 and further including preventing the hot combustion gases from coming into contact with the inside of said first and second melting vessels, whereby metal masses to be melted contained therein will be isolated from said combustion gases.

3. The method according to claim 1 wherein said step of burning comprises lining the inside of said melting chamber with a heat radiating and heat storing inner wall to cause said burning.

* * * * *